US005555622A

United States Patent [19]

Yamamoto et al.

[11] Patent Number: 5,555,622

[45] Date of Patent: Sep. 17, 1996

[54] METHOD OF MANUFACTURING A HEAT TRANSFER SMALL SIZE TUBE

[75] Inventors: Kouji Yamamoto; Toshiaki Hashizume; Hiroshi Kawaguchi, all of Tokyo, Japan

[73] Assignee: The Furukawa Electric Co., Ltd., Tokyo, Japan

[21] Appl. No.: 391,635

[22] Filed: Feb. 21, 1995

Related U.S. Application Data

[60] Continuation of Ser. No. 98,619, Jul. 28, 1993, abandoned, which is a division of Ser. No. 64,733, May 19, 1993, abandoned, which is a continuation of Ser. No. 832,222, Feb. 7, 1992.

[30] Foreign Application Priority Data

Feb. 13, 1991 [JP] Japan ..... 3-41068
Feb. 21, 1991 [JP] Japan ..... 3-48946

[51] Int. Cl.[6] ..... B23P 15/26

[52] U.S. Cl. ..... 29/890.053; 29/890.05; 29/890.03

[58] Field of Search ..... 29/890.03, 890.049, 29/890.053, 890.05; 165/179

[56] References Cited

U.S. PATENT DOCUMENTS

| | | | |
|---|---|---|---|
| 4,044,797 | 8/1977 | Fujie et al. | 165/179 |
| 4,545,428 | 10/1985 | Onishi et al. . | |
| 4,658,892 | 4/1987 | Shinohara et al. . | |
| 4,705,103 | 11/1987 | Zogg et al. . | |
| 4,866,830 | 9/1989 | Zohler | 165/179 |
| 4,876,869 | 10/1989 | Saeki et al. . | |
| 4,921,042 | 5/1990 | Zohler | 165/179 |
| 4,938,282 | 7/1990 | Zohler | 165/179 |
| 5,052,476 | 10/1991 | Sukumoda et al. . | |
| 5,275,234 | 1/1994 | Booth | 165/179 |

FOREIGN PATENT DOCUMENTS

| | | |
|---|---|---|
| 0148609 | 7/1985 | European Pat. Off. . |
| 57-58088 | 4/1982 | Japan . |
| 62-098200 | 5/1987 | Japan . |
| 62-276397 | 12/1987 | Japan . |
| 63-172893 | 7/1988 | Japan . |
| 1-299707 | 12/1989 | Japan . |
| 2-97898 | 4/1990 | Japan . |

*Primary Examiner*—Irene Cuda
*Attorney, Agent, or Firm*—Frishauf, Holtz, Goodman, Langer & Chick

[57] ABSTRACT

A method of manufacturing a heat-transfer small size tube includes inserting a grooved plug in a metal tube having an outer diameter of 4.5 mm or more, performing a rotary or drawing process with respect to the outer surface of the metal tube while pulling the metal tube in the tube-axis direction, thereby continuously forming grooves, in the inner surface of the metal tube, in a spiral shape or in the tube-axis direction, each of the grooves having a ridge bottom width/bottom wall thickness ratio $W_2/t$ defined as 0.2 to 1.5, a groove depth H defined as 0.15 to 0.30 mm, and a groove bottom width $W_1$ defined as 0.15 to 0.50, and subjecting to diameter reduction process with a diameter reduction rate of 20 to 40% by performing at least one draw without plug process with respect to the metal tube to obtain a heat-transfer small size tube having a groove depth H defined by $0.15<H<0.25$ mm.

6 Claims, 12 Drawing Sheets

METHOD OF MANUFACTURING A HEAT TRANSFER SMALL SIZE TUBE

This application is a continuation of application Ser. No. 08/098,619, filed Jul. 28, 1993, abandoned, which is a Division of Ser. No. 08/064,733 filed May 19, 1993, abandoned, which is a continuation of Ser. No. 07/832,222 filed Feb. 7, 1992, abandoned.

BACKGROUND OF THE INVENTION

1. Field of the Invention

The present invention relates to a heat-transfer small size tube used for a heat exchanger in a refrigerator, an air conditioner, or the like, and a method of manufacturing the same.

2. Description of the Related Art

Recently, there have been strong demands for an energy- and space-saving heat pump type air conditioners with these demands, it is required to realize a highly efficient, compact heat exchanger as a main component.

In heat pump air conditioners, cross fin type heat exchangers are most frequently used. This cross fin type heat exchanger is manufactured in the following manner. Heat-transfer tubes are inserted in aluminum fins having louvers or the like formed in its surface to exchange heat with air, and a through hole formed therein to allow the heat-transfer tube to be inserted. Expansion plugs are then inserted into the heat-transfer tubes to expand the tubes, thus causing the outer surface of the heat-transfer tube to come into contact with the aluminum fin. The resulting structure is assembled in the main body of the heat exchanger, thus completing the manufacturing process. When the cross fin type heat exchanger is to be used, refrigerant such as Freon is fed into the heat-transfer tube.

Smooth tubes are used as conventional heat-transfer tubes. Recently, however, an inner grooved tube has been developed. This tube has a large number of fine spiral grooves formed in its inner surface with this tube, the performance of inside heat transfer coefficient has been improved, and hence the performance of heat exchangers have been improved. Currently, therefore, inner grooved tubes having outer diameters of 9.53 mm and 7.00 mm are mostly used.

Recently, there have been strong demands for more compact heat exchangers. In order to meet the demands, a compact heat exchanger effectively using heat-transfer tubes having an outer diameter of about 4 mm is being developed. Under the circumstances, the present inventors previously disclosed a heat-transfer small size tube in Published Unexamined Japanese Patent Application No. 62-98200.

A simple application of heat-transfer small size tubes, however, causes an increase in the inside pressure drop and makes no contribution to an increase in the performance of a heat exchanger. In order to more effectively use small size tubes, a high performance heat transfer small tube having optimized groove shape must be developed.

In addition, when heat-transfer tubes are expanded and assembled in a heat exchanger, ridges formed on the inner surface of the heat-transfer tube are deformed. If the wall thickness is constant, ridges on the tube inner surface deform more with a decrease in tube diameter, thus deforming the grooves. It is generally known that the groove depth greatly influences the heat transfer performance of a heat-transfer tube. Therefore, in order to improve the efficiency of a heat exchanger, the degradation in heat transfer performance due to deformation of grooves must be minimized.

In the manufacture of such inner grooved small size tubes, if an excessively narrow tube is processed by a method similar to the conventional manufacturing method, the tube may be broken in grooving process.

If, however, a grooving process is performed with respect to a tube having a very large outer diameter, and the tube is worked into a small size tube with a large diameter reduction rate, fine depressions 2 may be formed in the outer surface of a heat-transfer tube 1, as shown in FIG. 1, or split defects 3 on the metal surface are often caused on the outer surface of the heat-transfer tube. Therefore, this method is not suitable for the manufacture of this tube.

SUMMARY OF THE INVENTION

It is an object of the present invention to provide an inner grooved small size tube which exhibits excellent performance of inside heat transfer coefficient and can minimize deformation of grooves upon expansion of the tube when it is assembled in a heat exchanger.

This object is achieved by a heat-transfer small size tube comprising a metal tube having an outer diameter of 3 to 6 mm, and grooves continuously formed, in an inner surface of the metal tube, in a spiral shape or in a tube-axis direction, each of the grooves having a groove depth H defined by $0.15<H<0.25$ mm, and a groove bottom width $W_1$ defined by $0.10<W_1<0.20$ mm, wherein a ratio t/D of a bottom wall thickness of the metal tube to the outer diameter of the metal tube is $0.025 \leqq t/D \leqq 0.075$.

It is another object of the present invention to provide a manufacturing method of efficiently obtaining an inner grooved tube, specifically a heat-transfer small size tube, which exhibits excellent heat transfer performance and is free from deformation and split defects on the metal surface in a diameter reducing process.

This object can be achieved by a method of manufacturing a heat-transfer small size tube, comprising the steps of inserting a grooved plug in a metal tube having an outer diameter of not less than 4.5 mm, performing a rotary or drawing process with respect to an outer surface of the metal tube while pulling the metal tube in a tube-axis direction, thereby continuously forming grooves, in an inner surface of the metal tube, in a spiral shape or in the tube-axis direction, each of the grooves having a ridge bottom width/bottom wall thickness ratio $W_2/t$ defined as 0.2 to 1.5, a groove depth H defined as 0.15 to 0.30 mm, and a groove bottom width W1 defined as 0.15 to 0.50, and subjecting to diameter reduction process with a diameter reduction rate of 20 to 40% by performing at least one draw without plug; process with respect to the metal tube to obtain a heat-transfer small size tube having a groove depth H defined by $0.15<H<0.25$ mm, a groove bottom width $W_1$ defined by $0.10 \leqq W_1 \leqq 0.20$ mm, and a ratio t/D of the bottom wall thickness of the metal tube to the outer diameter of the metal tube, defined by $0.025 \leqq t/D \leqq 0.075$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An outer diameter D of a heat-transfer small size tube of the present invention is set to be 3 to 6 mm for the following reasons. If the outer diameter D is less than 3 mm, it is difficult to form grooves having predetermined shapes. In contrast to this, the outer diameter D exceeding 6 mm makes no contribution to a reduction in size of a heat exchanger.

In addition, a groove depth H is set to be $0.15<H<0.25$ mm; and a groove bottom width $W_1$, 0.10 to 0.20 mm to optimize the heat transfer performance while ensuring substantially the same workability and cost as those of a conventional inner grooved tube.

Furthermore, a bottom wall thickness t in relation to the tube outer diameter D is set to satisfy $0.025 \leqq t/D \leqq 0.075$ in order to minimize a decrease in heat transfer performance due to deformation of grooves. Note that a apex angle $\alpha$ of a ridge is preferably set to be $20° < \alpha < 50°$.

In a manufacturing method of the present invention, a ratio $W_2/t$ of the ridge bottom width to the bottom wall thickness is limited to 0.2 to 1.5 for the following reasons. If the ratio $W_2/t$ is less than 0.2, a grooving process cannot be performed because the ridge bottom width is too small with respect to the bottom wall thickness set in a normal manufacturing process. If the ratio $W_2/t$ exceeds 1.5, the bottom wall thickness is excessively reduced as compared with the ridge bottom width so that depressions are formed in the outer surface of the tube or split defects on the metal surface or the like are often caused in a diameter reducing process with a diameter reduction rate of 20 to 40% after a grooving process.

Figure 1:
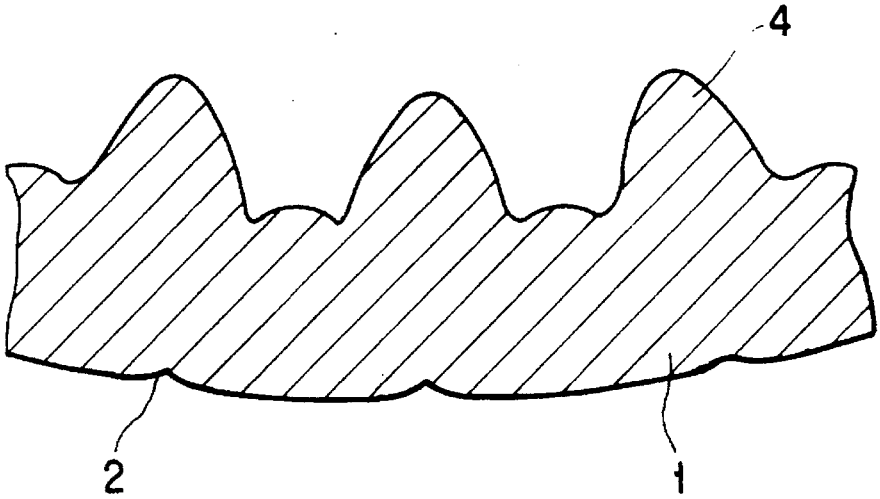
FIGS. 1 and 2 are sectional views respectively showing main parts of heat-transfer tubes obtained by a conventional manufacturing method.
Figure 2:
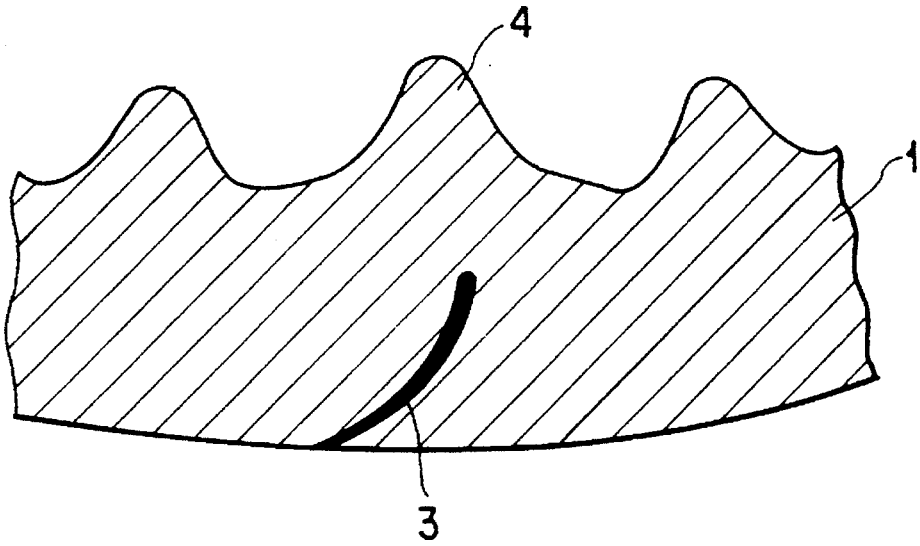

In general, in the process of reducing the diameter of a tube having a circular cross-section, a constant force acts in the circumferential direction. When an inner grooved tube is processed, since a ridge and a groove have different wall thicknesses, the circumferential force per unit area varies. For this reason, the wall thickness increase ratio in the diameter reducing process slightly varies. If the groove shape of a processed tube is such that the ridge bottom width is large as compared with the bottom wall thickness, depressions 2 are formed in an outer surface portion corresponding to a ridge 4, or split defects 3 on the metal surface extend into the tube wall, as shown in FIGS. 1 and 2. The diameter reduction rate after the grooving process is set to be 40% or less in order to suppress such defects to such an extent that no problems are posed in terms of manufacture. However, a diameter reduction rate of less than 20% results in loss of an advantageous feature in the diameter reducing process of a small size tube having a small manufacture weight per unit time, i.e., the feature that the manufacture weight is increased by reducing the diameter of the small size tube after the formation of grooves.

In the method of manufacturing a small size tube according to the present invention, the outer diameter of a metal tube is set to be 4.5 mm or more for the following reason. If the outer diameter is less than 4.5 mm, the pulling force required for a grooving process exceeds the breaking load of the tube, thus hindering the grooving process.

The groove depth of each groove formed in the inner surface of the metal tube is limited to 0.15 to 0.30 mm to set a finished groove depth of $0.15<H<0.25$ mm, in consideration of the fact that the reduction ratio in the process of reducing the diameter to 20 to 40% is 1.05 to 1.2. In addition, the groove bottom width of each groove formed in the inner surface of the metal tube is set to be 0.15 to 0.50 mm to set a finished groove width of $0.10 \leqq W_1 \leqq 0.20$ mm, in consideration of the fact that the reduction ratio in a diameter reducing process with a diameter reduction rate of 20 to 40% is 0.7 to 0.4.

An embodiment of the present invention will be described next.

Figure 3A:
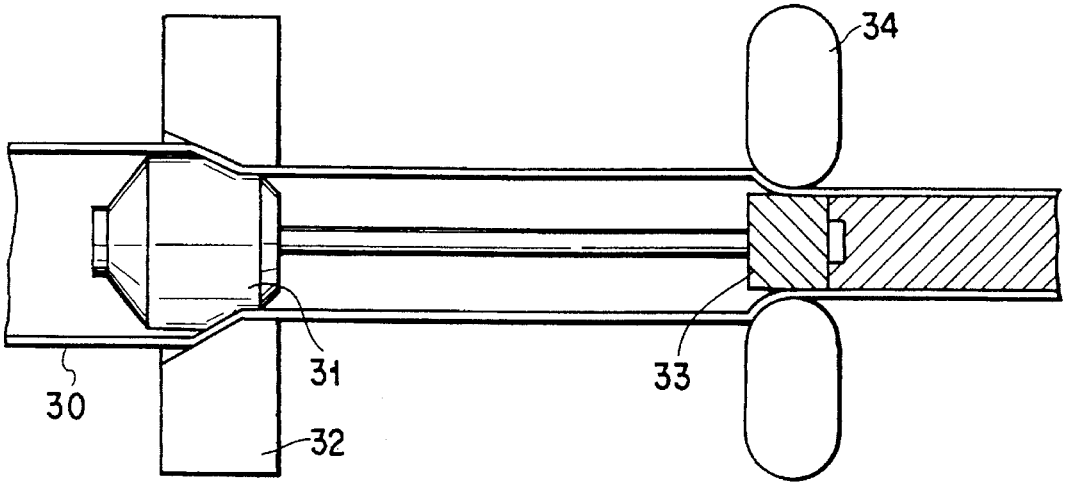
FIGS. 3A and 3B are views for explaining a rotary unit used in a method of manufacturing a heat-transfer small size tube according to the present invention.
Figure 3B:
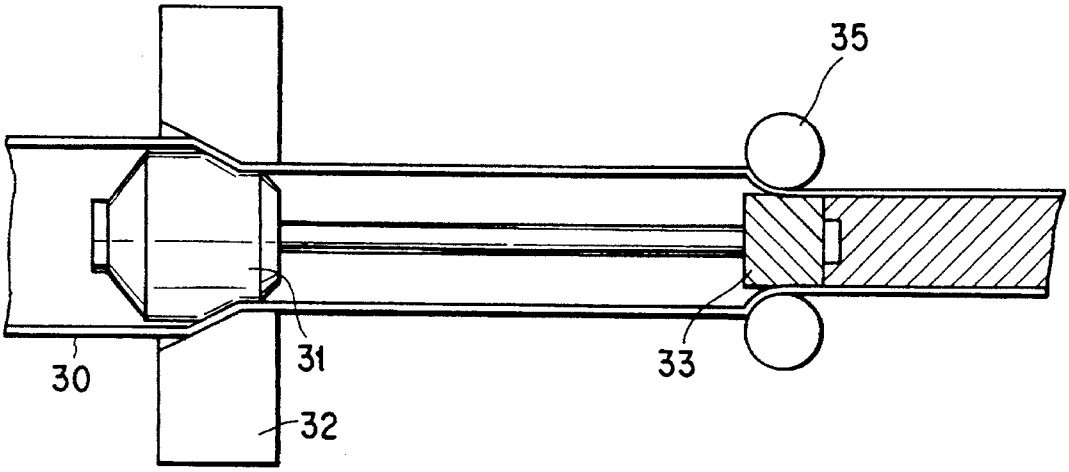

FIGS. 3A and 3B respectively show rotary units used in the manufacture of the heat-transfer small size tube of the present invention. Referring to FIG. 3A, a floating plug 31 is inserted in a metal tube 30, and a floating die 32 is arranged to draw the metal tube 30. In addition, a grooved plug 33 is held in the metal tube 30 at a predetermined position by the floating plug 31. Rotary rollers 34 are arranged outside the grooved plug 33. The arrangement of the rotary unit shown in FIG. 3B is the same as that of the rotary unit shown in FIG. 3A except that rotary balls 35 are used in place of the rotary rollers 34. Referring to FIG. 3A, β denotes a lead angle.

By using such a rotary unit, a rotary process was performed with respect to a phosphrous deoxidized copper tube. As a result, various types of inner grooved tubes having the cross-sectional shape shown in FIG. 4 and a length of about 1,000 m were manufactured. Each tube had a groove depth of 0.1 to 0.3 mm, a bottom wall thickness of 0.2 to 0.35 mm, and a ridge bottom width/bottom wall thickness ratio $W_2/t$ of 0.2 to 2.0.

Figure 4:
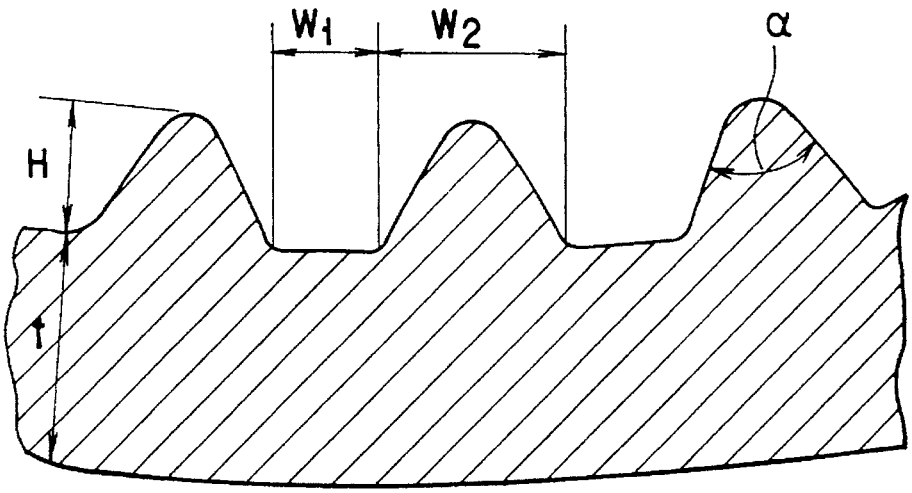
FIG. 4 is a sectional view showing a main part of a heat-transfer tube obtained by the manufacturing method of the present invention.

Referring to FIG. 4, reference symbol $W_1$ denotes a groove bottom width; and α, an apex angle of a ridge. Subsequently, a diameter reducing process with a reduction rate of 38% was performed with respect to each tube to manufacture a heat-transfer small size tube having an outer diameter of 4 mm and a groove depth of 0.09 to 0.25 mm.

Figure 5:
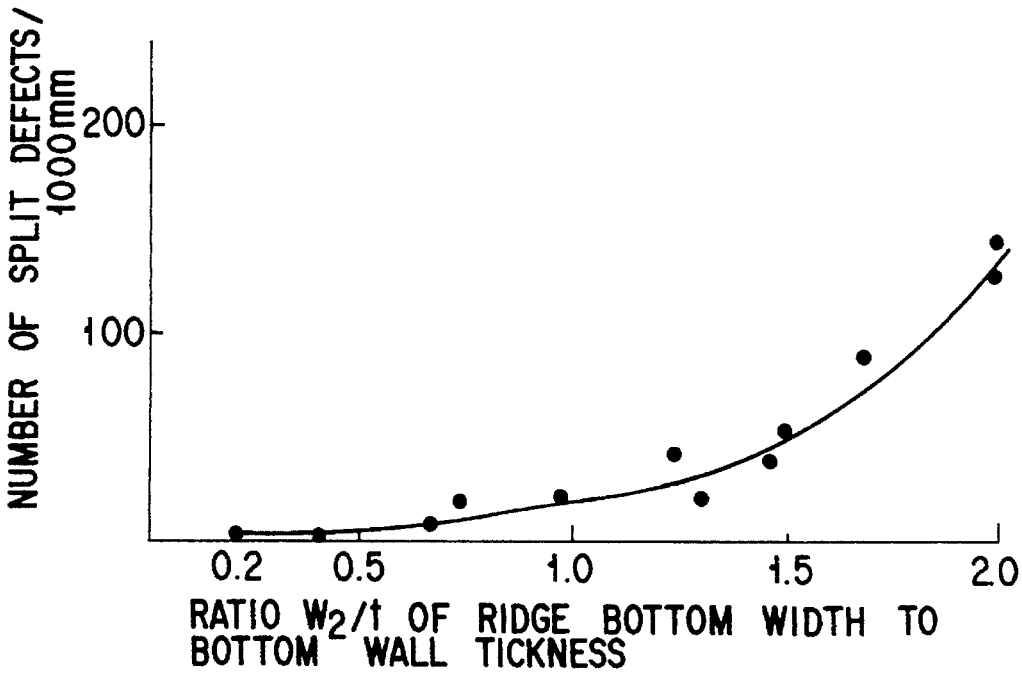
FIG. 5 is a graph showing the relationship between the number of split defects on the metal surface and the ratio of the ridge bottom width to the bottom wall thickness of a heat-transfer small size tube according to an embodiment of the present invention.

The number of split defects on the outer surface of each heat-transfer small size tube was checked. FIG. 5 shows the result. Note that a grooving process could not performed when the ratio $W_2/t$ was less than 0.2. As is apparent from FIG. 5, when the ratio $W_2/t$ exceeds 1.5, the number of split defects increases abruptly. For this reason, it is required that the ratio $W_2/t$ of the ridge bottom width to the bottom wall thickness be 0.2 to 1.5.

Figure 6:
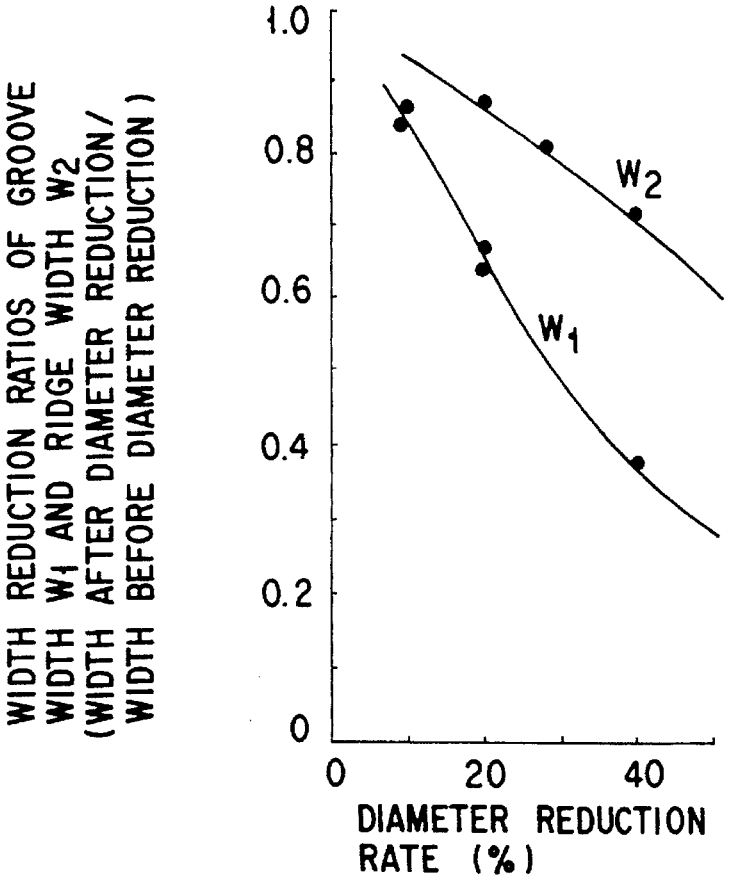
FIG. 6 is a graph showing the relationship between the diameter reduction rate and the width reduction ratios of the groove bottom width and the ridge bottom width before and after a diameter reducing process.
Figure 7:
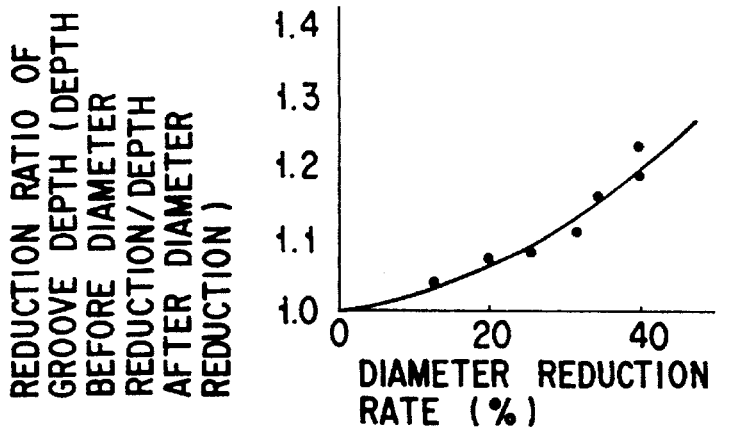
FIG. 7 is a graph showing the relationship between the diameter reduction rate and the reduction ratio of the groove depth before and after the diameter reducing process.
Figure 8:
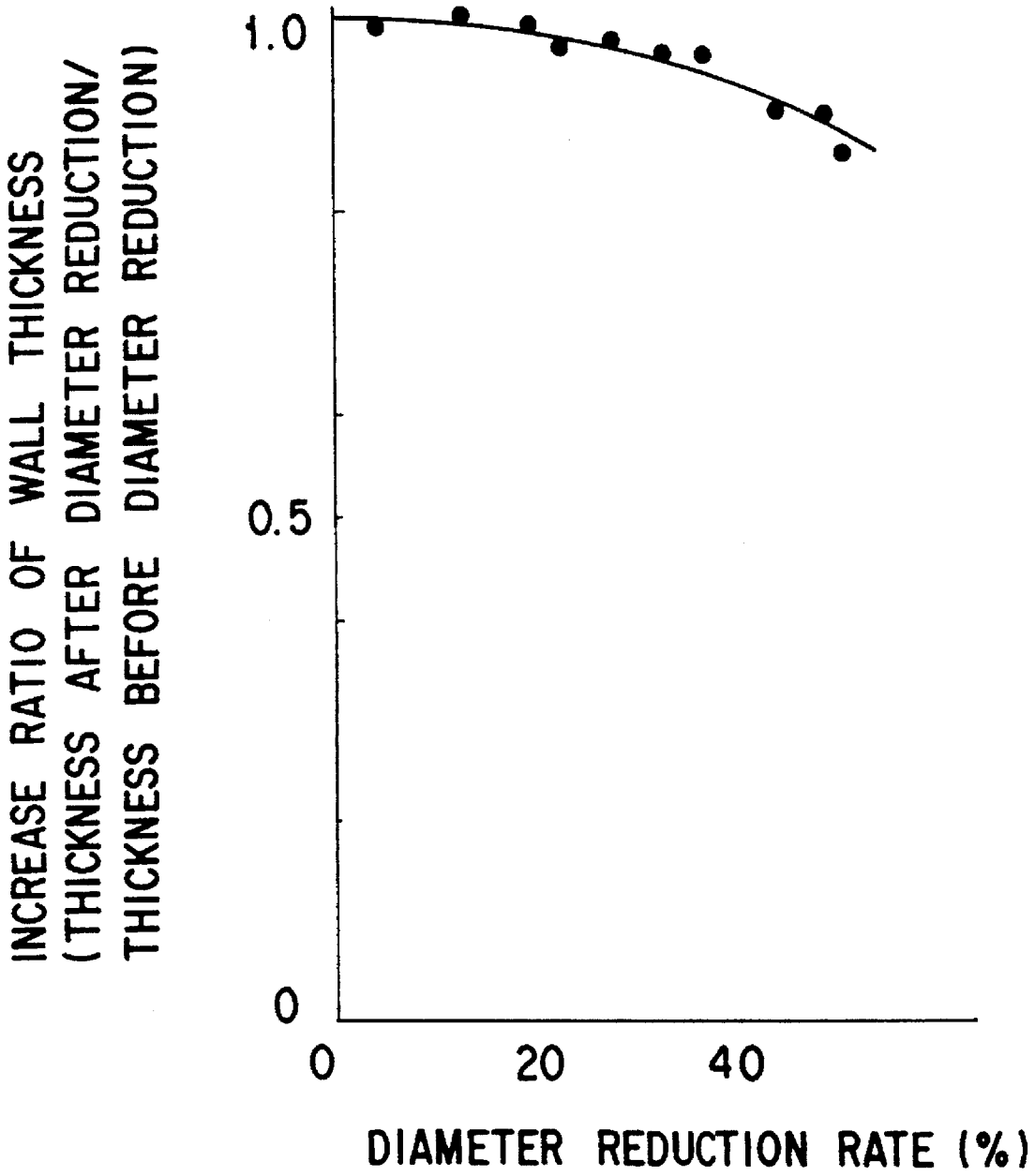
FIG. 8 is a graph showing the relationship between the diameter reduction rate and the increase ratio of the wall thickness before and after the diameter reducing process.

In addition, a rotary process was performed with respect to a tube having an outer diameter of 5.5 to 9.53 mm by using a grooved plug having an outer diameter of 4.5 to 7.5 mm, thus manufacturing inner grooved tubes with various sizes. A diameter reducing process with a diameter reduction rate of 20 to 40% was performed with respect to each inner grooved tube by performing at least one draw without plug process, thus manufacturing a heat-transfer small size tube having an outer diameter of 3 to 6 mm. FIGS. 6 to 8 respectively show the relationship between the diameter reduction ratio and the width reduction ratios of the groove bottom width and the ridge bottom width before and after the diameter reducing process (width after diameter reducing process/width before diameter reducing process), the relationship between the reduction rate and the reduction ratio of the groove depth before and after the diameter reducing process (depth after diameter reducing process/depth before diameter reducing process), and the relationship between the reduction rate and the increase ratio of the wall thickness before and after the diameter reducing process (thickness after diameter reducing process/thickness before diameter reducing process).

Referring to FIG. 6, the reduction ratios of the groove bottom width and the ridge bottom width are decreased as the reduction rate is increased. Referring to FIG. 7, the reduction ratio of the groove depth is increased as the reduction rate is increased. Referring to FIG. 8, the wall thickness increase ratio is decreased as the reduction rate is increased. As is apparent from these results, in order to obtain a desired groove shape, the diameter reduction rate must be set to be 20 to 40%.

Subsequently, a rotary process was performed with respect to phosphrous deoxidized copper tube, thus manufacturing inner grooved tubes having various sizes. Each tube had an outer diameter of 6.5 mm, a groove depth of 0.1 to 0.22 mm, a bottom wall thickness of 0.22 to 0.29, and a groove bottom width $W_1$ of 0.125 to 0.625 mm. A diameter reducing process with a diameter reduction rate of 38% was performed with respect to each inner grooved tube by sinking process, thereby manufacturing a heat-transfer small size tube having an outer diameter of 4 mm, a groove depth of 0.09 to 0.19 mm, a bottom wall thickness of 0.23 to 0.30 mm, and a groove bottom width of 0.05 to 0.25 mm. Table 1 shows the sizes of some representative heat-transfer small size tubes.

TABLE 1

| No. | Outer Diameter D (mm) | Minimum Inner Diameter (mm) | Number of Grooves | Lead Angle (°)β | Groove Depth H (mm) | Groove Bottom Width $W_1$ (Mm) |
|---|---|---|---|---|---|---|
| 1 | 4.00 | 3.14 | 50 | 2 | 0.15 | 0.05 |
| 2 | 4.00 | 3.16 | 50 | 8 | 0.15 | 0.06 |
| 3 | 4.00 | 3.24 | 50 | 19 | 0.09 | 0.07 |
| 4 | 4.00 | 3.16 | 40 | 8 | 0.15 | 0.12 |
| 5 | 4.00 | 3.14 | 36 | 8 | 0.14 | 0.15 |
| 6 | 4.00 | 3.16 | 36 | 8 | 0.19 | 0.15 |
| 7 | 4.00 | 3.40 | — | — | — | — |

The performance of inside heat transfer coefficient of each heat-transfer small size tube was evaluated. Note that the performance of inside heat transfer coefficient of each tube was measured in the following manner. Each heat-transfer small size tube was assembled in a double tube type heat exchanger, and Freon R-22 was circulated inside the heat-transfer tube, while coolant or cooling water was flown outside the tube. Under the measurement conditions shown in Tables 2 and 3 below, the inside heat transfer coefficient and the inside pressure drop in evaporation or condensation were measured.

Table 2

Pressure of refrigerant at entrance: 1.8 Mpa

Superheat of refrigerant at entrance: 35° C.

Subcool of refrigerant at exit: 5° C.

Temperature of coolant at entrance : 25°, 30°, 35°, 40° C.

Flow rate of refrigerant: 400 $kg/m^2S$

Water velocity: 2.4 m/s

The length of tested tube: 1 m

Type of refrigerant: R-22

Table 3

Pressure of refrigerant at exit: 0.39 Mpa

Quality at entrance: 0.21

Superheat of refrigerant at exit: 5° C.

Temperature of cooling water at entrance : 10°, 15°, 20°, 25° C.

Flow rate of refrigerant: 400 $kg/m^2S$

Water velocity: 1.6 m/s

The length of tested tube: 1 m

Type of refrigerant: R-22

Figure 9:
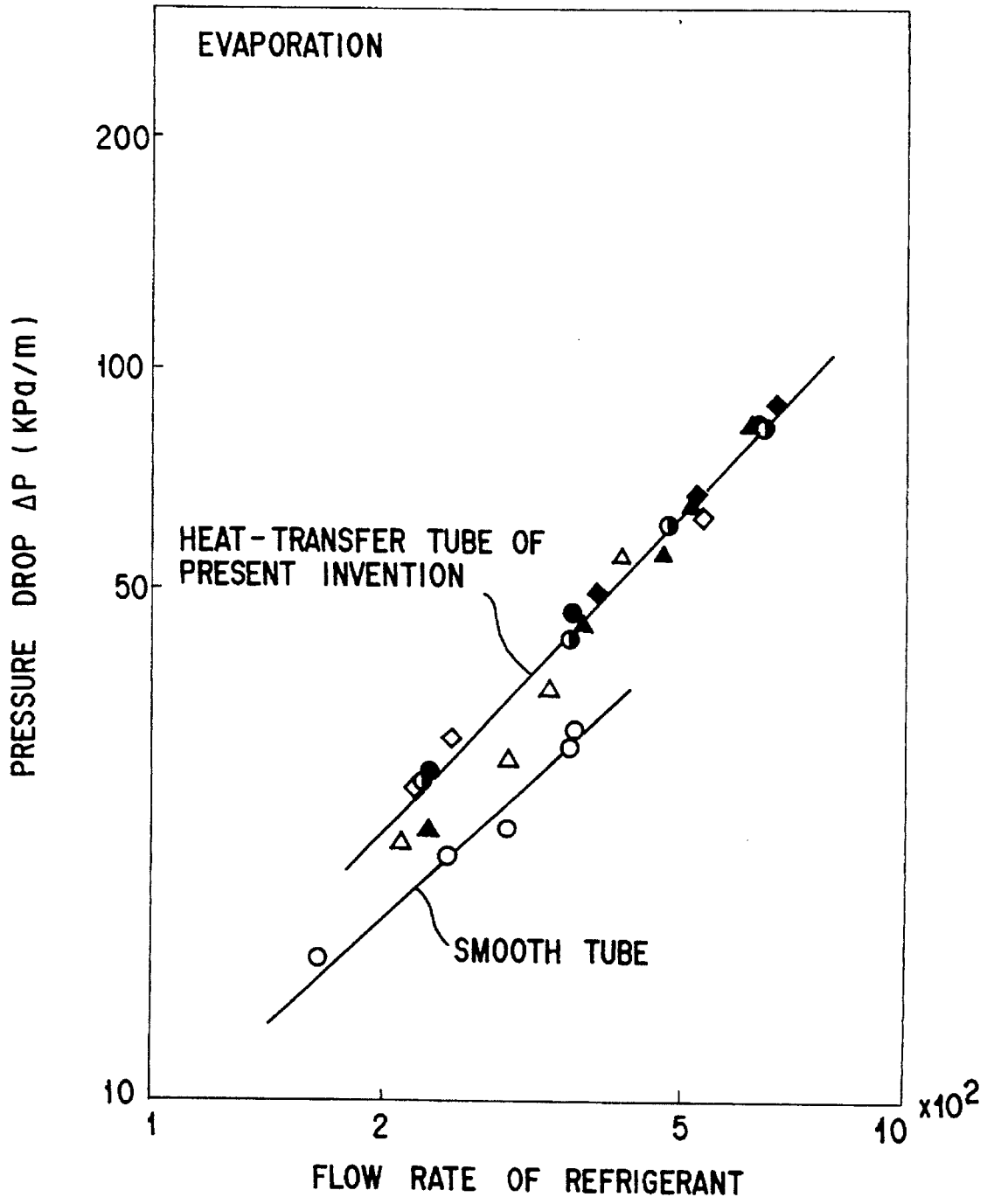
FIG. 9 is a graph showing the relationship between the flow rate of a refrigerant and the inside pressure drop in evaporation.
Figure 10:
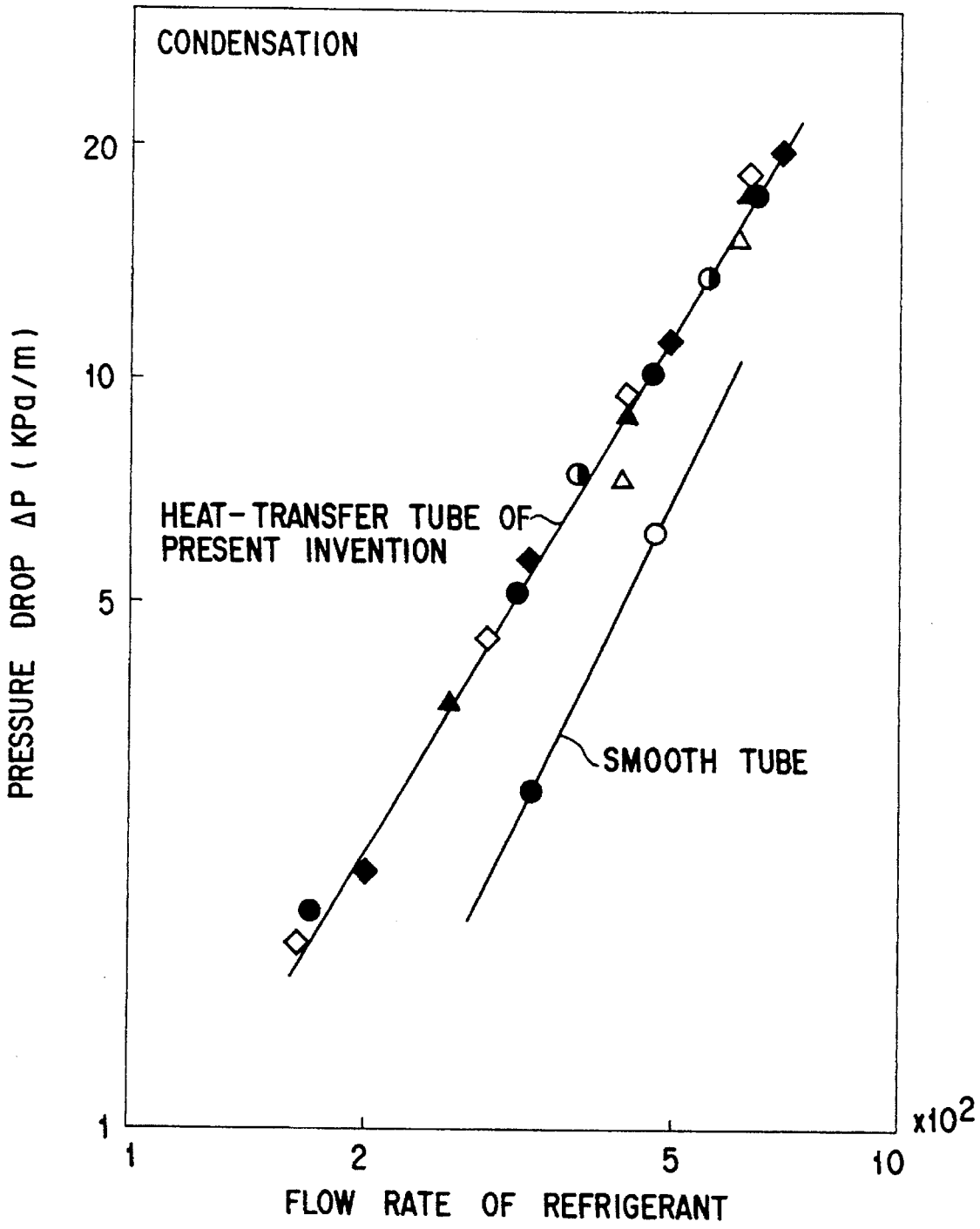
FIG. 10 is a graph showing the relationship between the flow rate of the refrigerant and the inside pressure drop in condensation.

FIGS. 9 and 10 respectively show the relationship between the flow rate of the refrigerant and the inside pressure drop in evaporation and that in condensation. As is apparent from FIG. 10, in condensation, owing to the influence on the grooves, the inside pressure drop in the heat-transfer small size tube of the present invention is 1.8 times that in a smooth tube. However, there is almost no difference in pressure drop, based on the difference in groove shape, e.g., groove depth. In addition, as is apparent from FIG. 9, in evaporation, there is only a small difference in pressure drop, based on the difference in groove shape. That is, the inside pressure drop in the heat-transfer small size tube of the present invention is 1.4 times that of the smooth tube.

Figure 11:
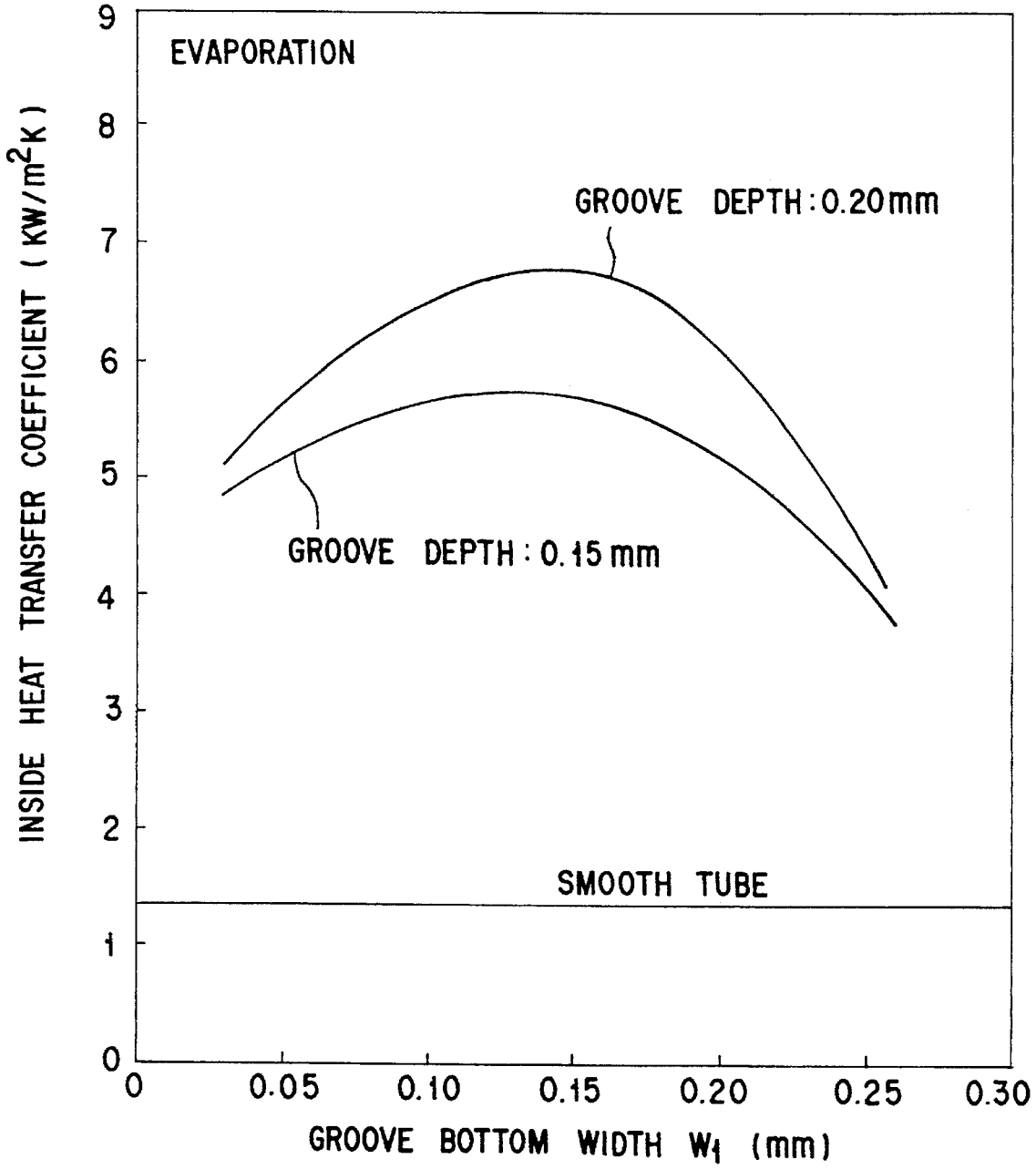
FIG. 11 is a graph showing the relationship between a groove bottom width $W_1$ and the inside heat transfer coefficient in evaporation.
Figure 12:
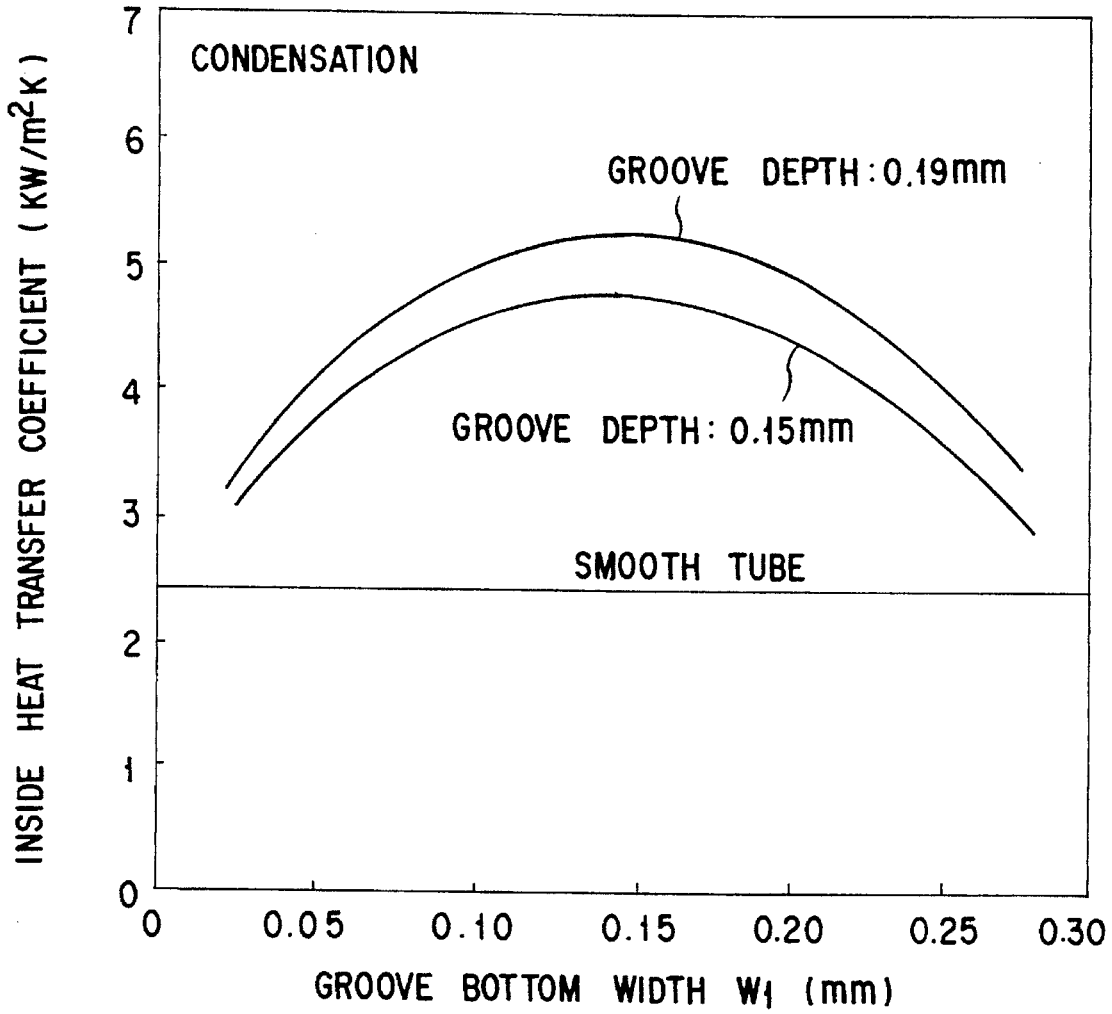
FIG. 12 is a graph showing the relationship between the groove bottom width $W_1$ and the inside heat transfer coefficient in condensation.

FIGS. 11 and 12 respectively show the relationship between the groove bottom width $W_1$ and the inside heat transfer coefficient in evaporation and that in condensation. In this case, the flow rate of the refrigerant is set to be 400 $kg/m^2s$. As is apparent from FIG. 11, if the groove depth is increased, an optimal value exists near $W_1$=0.1 to 0.20 mm. If the number of grooves is increased while the groove depth is kept constant, the circumferential length of the inner surface of the heat-transfer tube is increased, and the heat transfer performance is also improved. If, however, the number of grooves is excessively increased, the groove bottom width is extremely reduced, resulting in difficulty in forming a liquid film in the tube. As a result, each groove is always filled with a liquid, and hence the inside heat transfer performance is degraded. That is, the optimal values of the circumferential length of the inner surface of the heat-transfer tube and the liquid film amount in each groove exist near 0.1 to 0.20 mm.

Figure 13:
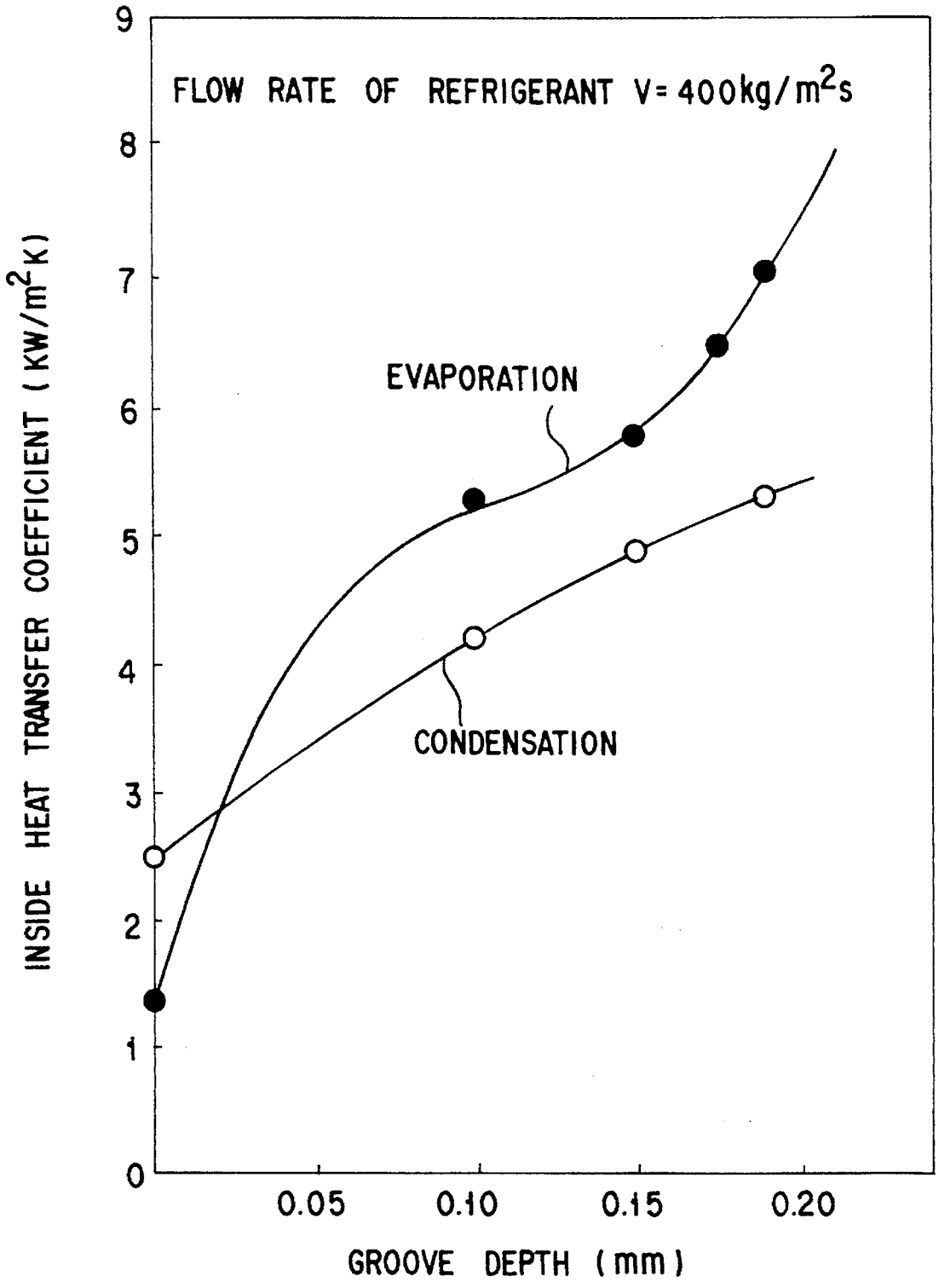
FIG. 13 is a graph showing the relationship between the groove depth and the inside heat transfer coefficient.

FIG. 13 shows the maximum value of inside heat transfer performance with respect to each groove depth obtained from FIGS. 11 and 12. As is apparent from FIG. 13, in condensation, the inside heat transfer coefficient is increased substantially in proportion to the groove depth. In contrast to this, in evaporation, the inside heat transfer coefficient tends to abruptly increase at a groove depth H=0.15 mm or more. In addition, considering that the pressure drop in evaporation is 1.8 times that in a smooth tube, the inside heat transfer performance of the heat-transfer small size tube of the present invention is at least twice that of a smooth tube. Therefore, it is required that the groove depth be set to be H>0.15 mm. If the groove depth is set to be H>0.15 mm, in order to improve the inside heat transfer performance, the groove bottom width must be set to be $0.10 \leqq W_1 \leqq 0.20$ mm, as is apparent from FIGS. 11 and 12. With this setting, the inside heat transfer performance nearly twice that of a smooth tube can be obtained in condensation. Furthermore, in evaporation, a remarkable improvement in inside heat transfer performance can be expected as compared with the case wherein $H \leqq 0.15$ mm.

Figure 14:
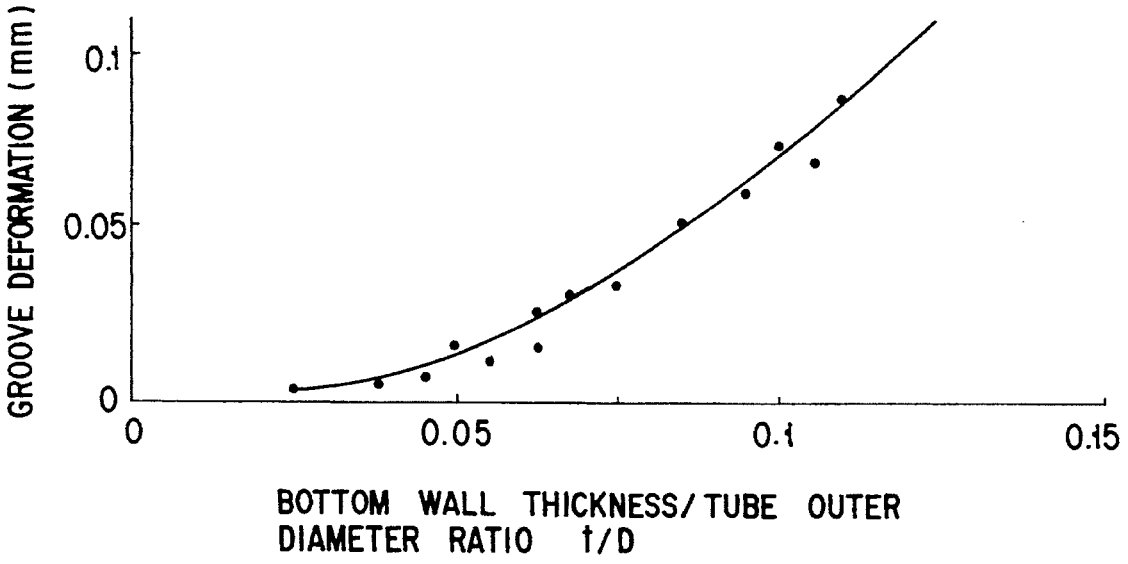
FIG. 14 is a graph showing the relationship between the groove deformation amount and the ratio of the bottom wall thickness to the tube outer diameter.

By employing the same method as described above, heat-transfer small size tubes, each having an outer diameter of 4 mm, 36 grooves, a groove depth of 0.22 mm, and a groove bottom width of 0.15 mm, were manufactured while the bottom wall thickness was variously changed. Thereafter, each heat-transfer small size tube was annealed, and an expansion plug having an outer diameter larger than the minimum inner diameter of the tube by 0.6 mm was inserted into the tube in the direction of tube axis to expand the tube. FIG. 14 shows the relationship between a groove deformation amount Δh (the difference between groove depths before and after the expansion of the tube) and a ratio t/D of the bottom wall thickness to the outer diameter. As is apparent from FIG. 14, the groove deformation amount is increased with an increase in bottom wall thickness. At $t/D \leqq 0.025$, the bottom wall thickness was excessively reduced, and the tube was broken in the grooving process.

Figure 15:
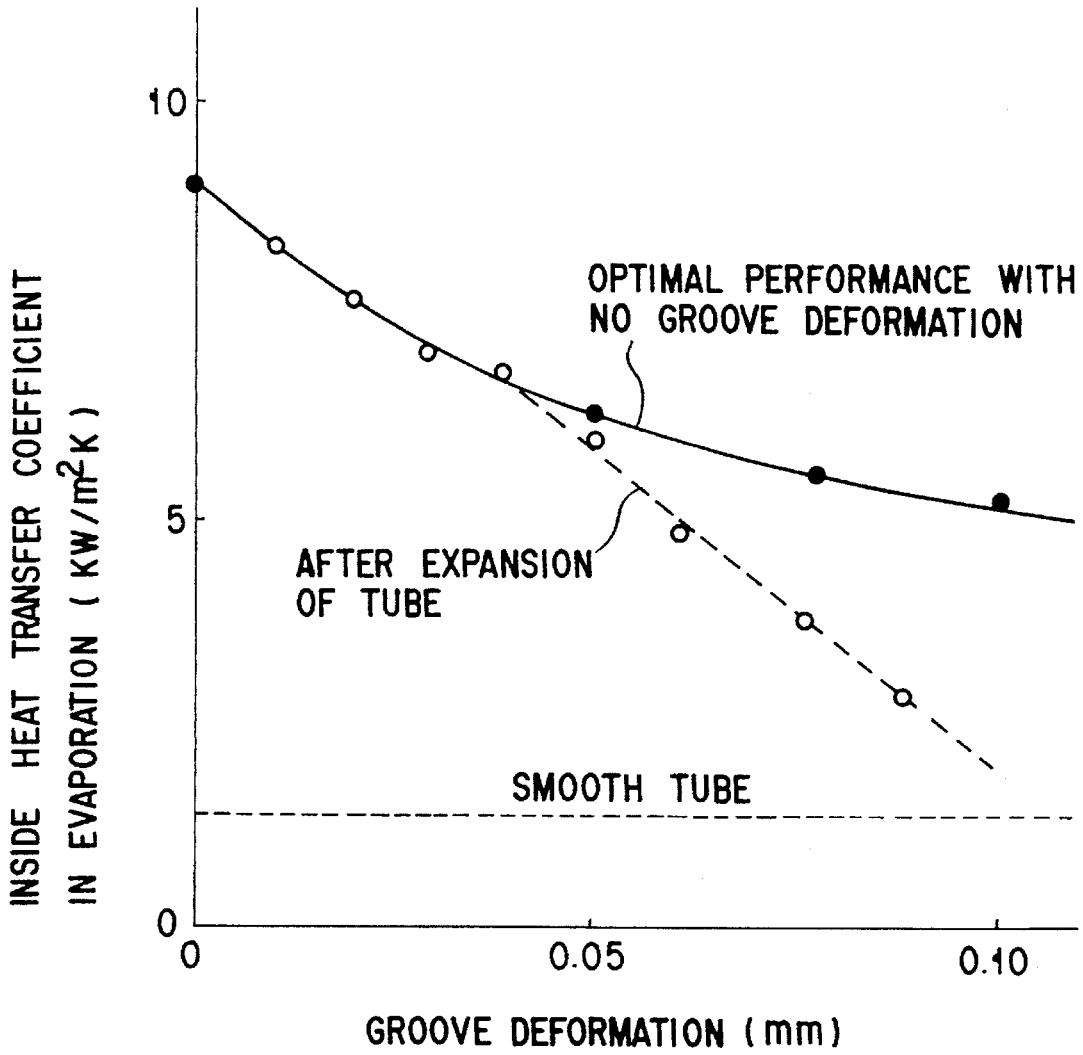
FIG. 15 is a graph showing the relationship between the groove deformation amount and the inside heat transfer coefficient in evaporation.

Subsequently, the inside heat transfer performance of each heat-transfer small size tube after the tube expansion process was measured by the same method as described above. FIG. 15 shows the inside heat transfer coefficient in evaporation, as the result, with respect to the groove deformation amount Δh. In addition, FIG. 15 shows the maximum inside heat transfer performance of a heat-transfer small size tube having the same groove depth as the groove depth after the tube expansion process, obtained from FIGS. 11 and 12. As is apparent from FIG. 15, when Δh<0.04, the inside heat transfer performance after the tube expansion process is deteriorated in accordance with a decrease in groove depth. When Δh>0.04, with a decrease in groove depth, each ridge deforms greatly to have a substantially trapedoizal cross-sectional shape, and the degradation in inside heat transfer performance becomes greater than that due to the influence of the decrease in groove depth. That is, the inside heat transfer performance of such a tube having deformed grooves is much lower than the performance obtained with a tube with grooves each having the same groove depth but an optimal shape.

Consequently, since t/D=0.075 when the groove deformation amount Δh=0.04, as shown in FIG. 14, the ratio t/D of the bottom wall thickness to the tube outer diameter is required to be $0.025 \leqq t/D \leqq 0.075$.

According to the heat-transfer small size tube of the present invention, the performance of inside heat transfer coefficient can be greatly improved. In addition, when the tube is expanded to be brought into tight contact with a fin, the degradation in performance due to the deformation of grooves can be minimized. This makes it possible to manufacture a compact heat exchanger which is much smaller and more efficient than a conventional heat exchanger. In addition, according to the manufacturing method of the present invention, a heat-transfer tube having high heat transfer performance, specifically a heat-transfer small tube, can be efficiently manufactured while the formation of depressions and split defects on the metal surface is suppressed.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of manufacturing a heat-transfer small size metal tube, comprising the steps of: inserting a grooved plug in a metal tube having an outer diameter of not less than 4.5 mm; performing a rotary process with respect to an outer surface of said metal tube while pulling said metal tube in a tube-axis direction, thereby continuously forming grooves in an inner surface of said metal tube in a spiral shape wherein the spiral shape extends in the tube-axis direction, each of said spiral shape grooves having a ridge bottom width/bottom wall thickness ratio defined as $W_2/t$ of 0.2 to 1.5, a groove depth H of 0.15 to 0.3 mm, and a groove bottom width $W_1$ of 0.15 to 0.5 mm; and subjecting the metal tube to a diameter reduction process with a diameter reduction rate of 20 to 40% by performing at least one draw without a plug with respect to said metal tube to produce a heat-transfer small size tube having a ratio t/D of 0.025<t/D<0.075, where t is said bottom wall thickness and D is the outer diameter of the metal tube.

2. The method according to claim 1, wherein the produced heat-transfer small size tube has:

a groove depth H defined by 0.15<H<0.25 mm, and a groove bottom width $W_1$ defined by $0.1 \leqq W1 \leqq 0.2$ mm.

3. The method according to claim 1, wherein the produced heat-transfer small size metal tube has a length of about 1,000 meters.

4. A method of manufacturing a heat-transfer small size metal tube, comprising the steps of:

inserting a grooved plug in a metal tube having an outer diameter of not less than 4.5 mm;

performing a drawing process with respect to an outer surface of said metal tube while pulling said metal tube in a tube-axis direction, thereby continuously forming grooves in the inner surface of said metal tube in the tube-axis direction, each of said spiral shape grooves having a ridge bottom width/bottom wall thickness ratio defined as $W_2/t$ of 0.2 to 1.5, a groove depth H of 0.15 to 0.3 mm, and a groove bottom width $W_1$ of 0.15 to 0.5 mm; and subjecting the metal tube to a diameter reduction process with a diameter reduction rate of 20 to 40% by performing at least one draw without a plug with respect to said metal tube to produce a heat-transfer small size tube having a ratio t/D of $0.025<t/D<0.075$, where t is said bottom wall thickness and D is the outer diameter of the metal tube.

5. The method according to claim 4, wherein the produced heat-transfer small size tube has:

a groove depth H defined by $0.15<H<0.25$ mm, and a groove bottom width $W_1$ defined by $0.1<W1\leqq 0.2$ mm.

6. The method according to claim 4, wherein the produced heat-transfer small size metal tube has a length of about 1,000 meters.

* * * * *